United States Patent [19]

Salomon

[11] 4,170,372

[45] Oct. 9, 1979

[54] DEVICES MOUNTED ON A SKI

[75] Inventor: Georges P. J. Salomon, Annecy, France

[73] Assignee: S.A. des Etablissements Francois Salmon & Fils, Annecy, France

[21] Appl. No.: 952,132

[22] Filed: Oct. 17, 1978

Related U.S. Application Data

[63] Continuation of Ser. No. 747,526, Dec. 6, 1976, abandoned.

[30] Foreign Application Priority Data

Dec. 11, 1975 [FR] France ..... 75 37908

[51] Int. Cl.[2] ..... A63C 9/085

[52] U.S. Cl. ..... 280/626; 280/628

[58] Field of Search ..... 280/630, 629, 628, 625, 280/626

[56] References Cited

U.S. PATENT DOCUMENTS

| | | | |
|---|---|---|---|
| 3,822,071 | 7/1974 | Mottet | 280/625 |
| 3,902,728 | 9/1975 | Salomon | 280/629 |
| 3,920,256 | 11/1975 | Sittmann | 280/625 |

FOREIGN PATENT DOCUMENTS

| | | | |
|---|---|---|---|
| 2214091 | 9/1973 | Fed. Rep. of Germany | 280/630 |
| 2364298 | 6/1975 | Fed. Rep. of Germany | 280/628 |

*Primary Examiner*—David M. Mitchell

*Attorney, Agent, or Firm*—Haseltine, Lake & Waters

[57] ABSTRACT

A safety binding adapted to be mounted on a ski.

This binding comprises a one-piece jaw in which engages and is maintained one end of the sole of a ski boot, this jaw being urged under the action of a resilient device against two support lines and being characterized in that the support lines, viewed along the axis of the ski, converge towards a point located above the ski.

7 Claims, 7 Drawing Figures

DEVICES MOUNTED ON A SKI

This is a continuation of application Ser. No. 747,526, filed Dec. 6, 1976 and now abandoned.

FIELD OF INVENTION

The present invention relates to a safety binding adapted to be mounted on a ski.

BACKGROUND

Safety bindings called front abutments, are known which comprise a one piece jaw in which engages and is maintained the front part of the sole of a ski boot. This jaw is maintained in contact against two lateral support lines disposed respectively on each side of the longitudinal axis of the ski and the jaw is urged towards the front of the ski under the action of a resilient member. As a result the jaw can pivot on one or the other of the support lines when the foot of a skier is subjected to a torsional force in one direction or the other to insure release.

In this known safety binding, the two support lines are vertical, that is to say perpendicular to the upper surface of the ski. Such an arrangement has the disadvantage that, in certain instances of release of the safety binding, an increase in the release force is caused. This especially occurs when the binding is urged vertically during the course of a lateral release.

Indeed, as the sole engages under the edge of the jaw or the sole clip and the point of support is at the same horizontal level, there results a significant chafing of the sole under the edge, which chafing produces a resisting force opposing movement with a resulting increase in the release force. Due to this, good functioning of the security binding is prevented.

SUMMARY OF INVENTION

The present invention has for an object the obviating or mitigating of these disadvantages by providing a simple particular mounting of the jaw.

According to the present invention, there is provided a safety binding for a ski comprising a one-piece jaw in which can be engaged and maintained one end of the sole of ski boot, a body connectible to a ski and providing two lateral support lines disposed respectively on either side of the longitudinal of symmetry plane of the ski, resilient means urging the jaw against the support lines so that the jaw can pivot on either line of support, the lines of support viewed along the axis of the ski converging towards a point disposed above the ski.

Due to the particular disposition of the support lines of the jaw of the security binding according to the invention, this jaw, during its pivotal movement around one of the lines of support during a release operation, lifts slightly in the direction of release which practically obviates the chafing due to the vertical urging of the binding during lateral release and consequently does not cause an increase in the release force.

BRIEF DESCRIPTION OF DRAWING

Embodiments of the present invention will now be described, by way of example, with reference to the accompanying drawings, in which.

DETAILED DESCRIPTION

Figure 1:
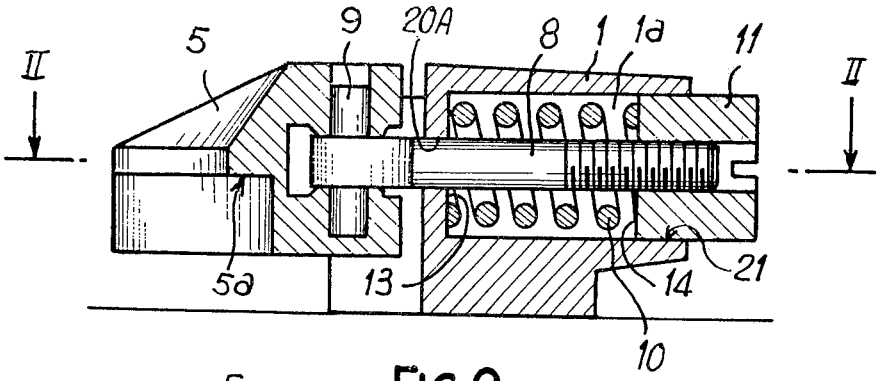
FIG. 1 is a vertical axial section of a safety binding according to invention.
Figure 2:
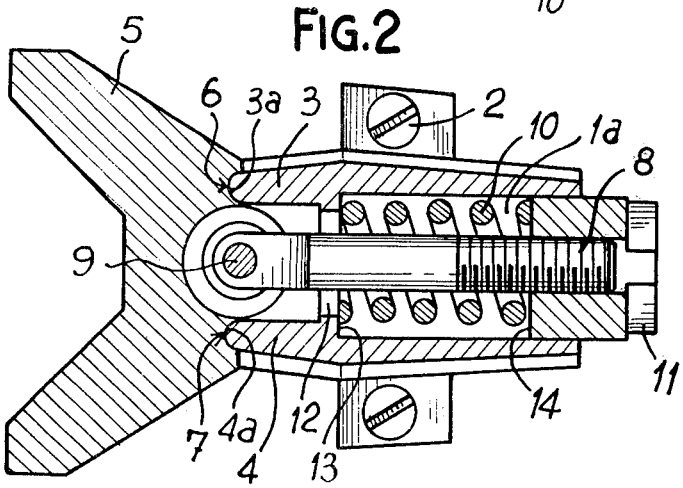
FIG. 2 is a horizontal sectional view on the line II—II of FIG. 1.
Figure 3:
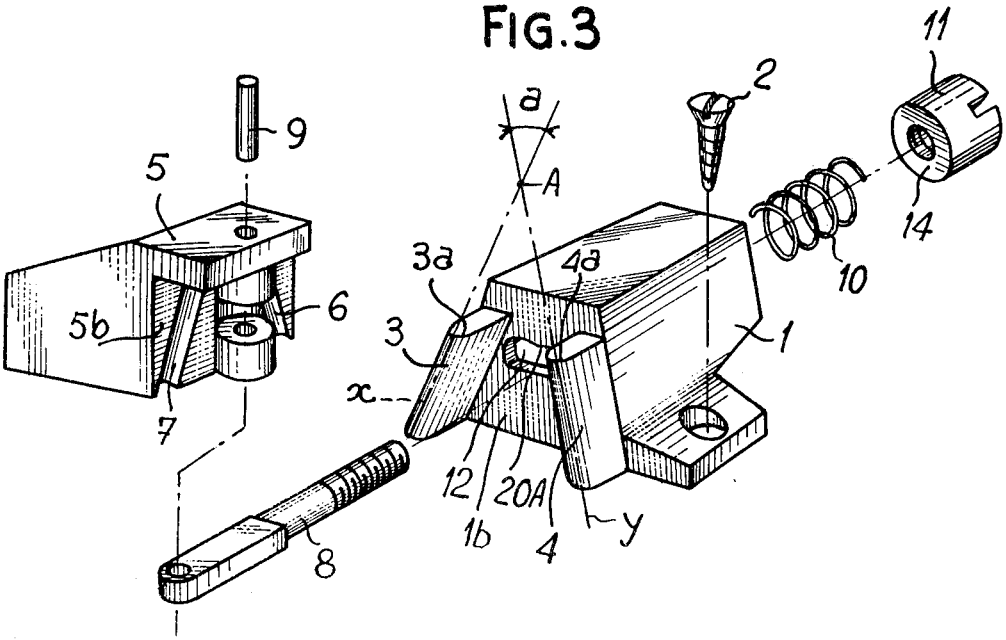
FIG. 3 is a schematic exploded perspective view of the safety binding of FIGS. 1 and 2.

The safety binding, according to one embodiment of the invention as is shown in FIGS. 1 to 3, comprises a body 1 which is fixed on the upper surface of a ski by means of screws 2. This body comprises a rear transverse wall 1*b* from which extend towards the rear, two ribs 3 and 4 integral with the body 1 or connected thereto. These ribs are rounded or radiused at their ends to form respective cylindrical surfaces 3*a* and 4*a* of small diameter, the axes x and y of which constitute, lines of support for a jaw 5. In the description which follows, reference will be made to lines of support x and y it being understood that they act as theoretical pivotal axes for the jaw 5, these axes being provided by the body 1, fixed on the ski.

According to the fundamental characteristic of the invention, the two support lines x and y viewed along the axis of the ski converge at a point A disposed above the ski. The two support lines x and y are symmetrical with reference to the longitudinal plane of symmetry of the ski and in this case they intersect at point A by subtending between them an angle a. In this case, the two support lines x and y are located in the same transverse plane.

However, this arrangement is not limitative and the two support lines x and y need not be located in the same transverse plane; that is to say, they may be offset. The jaw 5 is in one piece and presents two wings extending above the front part of the sole of a ski boot which they engage by an edge 5*a*.

The jaw 5 presents in its face 5*b*, transverse relative to the body 1, two recesses 6 and 7 of a form corresponding to the two support surfaces 3*a* and 4*a*. These recesses are thus preferably constituted by semi-cylindrical grooves of the same diameter as that of the support surfaces 3*a* and 4*a*, and the axes of which are symmetrical relative to the longitudinal of symmetry plane of the ski and subtending between them the same angle a.

A threaded rod 8 articulated on the jaw 5 around a central vertical axis or pin 9 maintains the jaw in contact with the body 1 due to a spring 10 located in a longitudinal bore 1*a* of the body 1 and disposed between the end 13 of this bore and a support face 14 on a button or stud 11 screwed on the screw-threaded extremity of the rod 8. The button 11 serves also as a tension regulating screw for the spring 10.

The rod 8 extends through the longitudinal bore 1*a* and it transverses the transverse wall 1*b* of the body which is opposite the jaw 5 by passing through a hole 12 which is elongate in the transverse direction.

Thus, upon a lateral release in one direction or the other the jaw pivots on the support line x in the case of a release to the left or on the support line y in the case of a release to the right in opposition to the action of the return spring 10 which is compressed between the base 13 of the bore 1*a* and the support face 14.

The vertical maintenance of the jaw 5 on the support surfaces 3*a* and 4*a* is assured by the rod 8 which is itself secured in the body in the vertical direction. For this purpose, the rod 8 is maintained vertically in the central part of the hole 12 by the upper edge 20*a* of the latter which is raised slightly in the lateral sense; that is to say, to the left and to the right, to permit a slight ascending movement of the rod 8 when the jaw pivots towards the left or towards the right. The rod 8 is also maintained in the body by the button 11 which bears by its peripheral surface 21 against the internal surface of the bore 1*a*.

According to a modification, one can reverse the disposition of the support surfaces 3*a*,4*a* and the grooves forming recesses 6 and 7 by providing the surfaces on the jaw 5 and the grooves in the body 1.

The height control of the mounting can be effected by means of a sole clip controllable by a screw mounted on the jaw 5 as is common in safety bindings.

Figure 4:
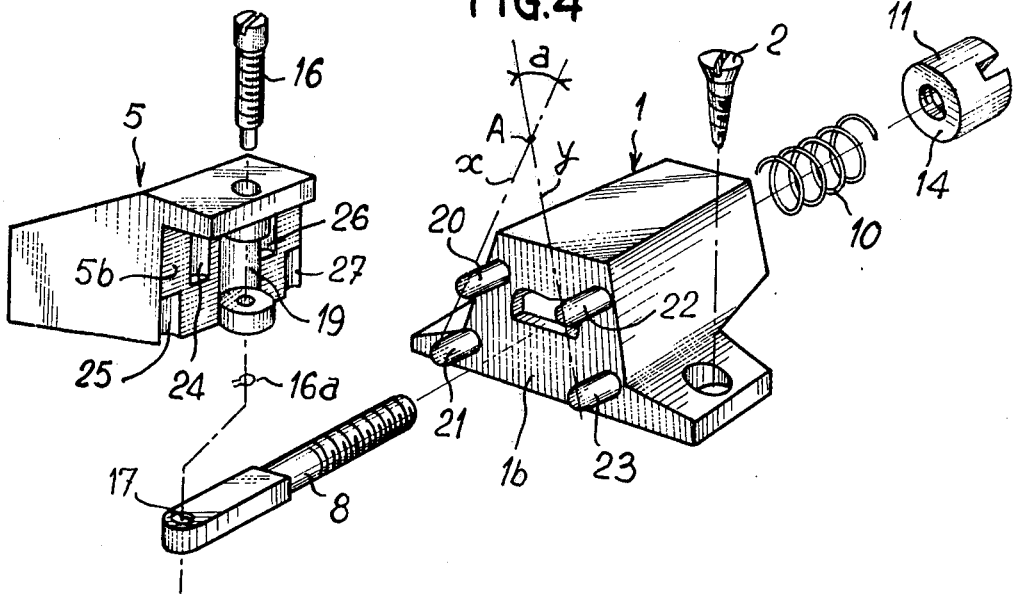
FIG. 4 is an exploded perspective view of a modification of the safety binding according to the invention.

Sometimes this control can be realized in the manner shown in FIG. 4. In this case, the axis of rotation 9 between the rod 8 and the jaw 5 is replaced by a screw 16 which is engaged in a tapped hole 17 provided in the rear end of the screw rod 8.

This rear end engages in a vertical recess 19 provided in the transverse face 5*b* of the jaw 5 to permit vertical displacement of the latter relative to the rod 8. In this case, the support lines x and y are provided by the alignment for each of them of two bosses or stems 20, 21 for the support line x and 22,23 for the support line y. The two support lines subtend between them an angle *a* and intersect at point A as in the case of the binding illustrated with reference to FIGS. 1 and 3. These bosses or stems 20 to 23 have any suitable form, for example spherical, conical, cylindrical, cubic, etc. They extend towards the rear and engage in respective vertical recesses 24, 25, 26, 27, provided in the front face 5*b* of the jaw 5. Dependent on the form of the bosses or stems and their recesses it is possible to produce upon a pivoting of the jaw 5 around one of the support lines x, y, a relative displacement of one of the pairs of bosses or stems 20, 21, or 22, 23 in their respective recesses 24, 25, or 26, 27.

The screw 16 which permits the height regulation of the jaw 5 is locked against withdrawal from this jaw after its assembly with the screw rod 8, for example, by means of a circlip 16*a*, or by rivetting.

It is to be noted that in the embodiment of FIG. 4, the lower support bosses or stems 21, 23, are in the same parallel plane as the surface of the ski and the same applies to the upper support bosses or stems 20, 22.

In a modification, the support bosses or stems 20 and 22 could be merged into a single support.

According to a modification, the support bosses or stems 20 to 23 could be carried by the jaw 5 and the recesses 24 to 26 could be provided in the transverse face 1*b* of the body 1.

In the mounting illustrated on FIG. 4, the vertical securement of the jaw is effected by means of the rod 8 as in the case of the mounting of FIGS. 1 to 3.

Figure 5:
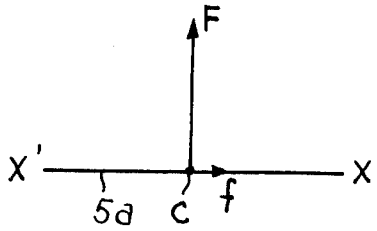
FIGS. 5 and 6 are diagrams respectively illustrating the decaying of the vertical force of a boot on the jaw in the case of a known binding and in the case of the binding according to the invention.
Figure 6:
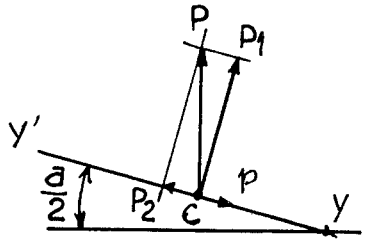

There will now be explained, with particular reference to FIGS. 5 and 6, the advantageous results which obtain from the converging disposition of the support lines x and y. In safety bindings, the vertical retention of the boot is generally effected by the edge 5*a* of the jaw or by a sole clip. Let C be the point of points of contact of the boot on this edge.

In a known safety binding (diagram of FIG. 5) the trajectory $X-X^1$ of the points of contact C of the boot on the jaw during release is parallel to the plane of the ski. The vertical force F applied by the boot on the edge 5*a* thus gives, during release of the boot a frictional force f because there is relative displacement of the boot and jaw. The direction of release being X towards $X^1$, the friction f thus provides a resisting force opposing movement with an increase in the releasing force.

On the contrary, in the safety binding according to the invention (diagram of FIG. 6) due to the fact that the lines of support x and y are inclined, the trajectory of the points of contact C follow the line $Y-Y^1$ is inclined at an angle a/2 relative to the plane of the ski. The force P applied by the boot on the edge 5*a* during release is resolved into two forces P1 perpendicular to $Y-Y^1$ and P2 along $Y-Y^1$. The force P1 produces a frictional force p opposing movement but which can be largely compensated for, by the force P2 which is in the direction of movement. There is thus, in this case, no increase in the releasing force. There will now be described with reference to FIG. 7, a further embodiment of the binding according to the invention. In this case, the jaw 28 is integral with a casing 29 of the binding which has a bore 30 in which is disposed the spring 31 of the binding.

The jaw 28 rests, as in previous cases, on two converging lines of support x and y formed by two ribs 3 and 4 extending towards the rear and integral with a support member 32 integral with a base plate 33 fixed to the ski. The support member 32 extends vertically in the interior of bore 30 and the ribs 3 and 4 with round surfaces are disposed in converging grooves 6 and 7 of corresponding form provided in the transverse face 29*a* of the casing 29 which constitutes the end of the bore 30 and the separation between the jaw 28 and the casing 29.

The loading of the binding comprises, besides the spring 31, an axial piston 34 which is slidably mounted at the front in a hole formed in the front transverse wall 29*b* of the casing 29 and which has at its rear a transverse collar 35. The spring 31 is thus compressed between this transverse collar 35 and the wall 29*b*. The collar 35 is extended towards the rear by an end part 36, preferably conical, which engages in the bottom of a recess 37, also preferably conical, provided in the front face of the support member 32. This support member 32 is reduced in cross-sectional area externally towards the front to facilitate rotation of the jaw 28.

Figure 7:
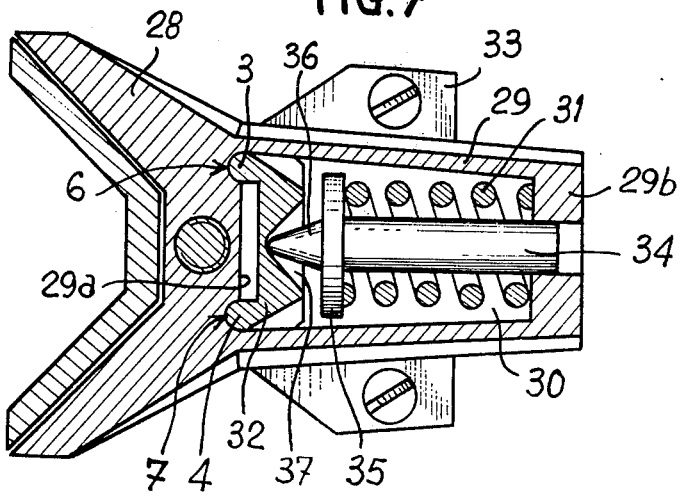
FIG. 7 is a horizontal sectional view of another modification of a binding according to the invention.

The functioning of the safety binding shown in FIG. 7, upon a release to right or to left, is the same as the other embodiments previously described. In the case of the binding of FIG. 7, the height control can be effected by means of a sole clip regulated by a screw mounted on the jaw.

Also, in the case of this binding, the lower front face of the casing must not have a form which would impede rotation of the assembly formed by it and the jaw 28. Indeed, certain points of the lower face of the casing have a decending trajectory upon release.

The invention is not limited to the above embodiments; in particular the binding could be used to maintain the rear of the boot. In this case, they must assure, in addition to a lateral release, a vertical release. Moreover, the jaw should be able to co-operate with a member attached temporarily or not on the boot.

What is claimed is:

1. A safety binding for a ski having a longitudinal plane of symmetry comprising a one-piece jaw in which can be engaged and maintained one end of the sole of a ski boot, a body connectible to said ski in front of said jaw, support means associated with said body and providing two lateral support lines disposed respectively on either side of the longitudinal plane of symmetry of the ski, resilient means urging the jaw against said support means at the support lines, said support means and jaw being engaged such that the jaw can pivot on either line of support, the lines of support viewed along the longitudinal axis of the ski converging towards a point disposed above the ski in order that in one direction of lateral movement of the jaw the jaw will pivot about one line of support and in the other direction of lateral movement of the jaw, the jaw will pivot about the other line of support, a threaded rod and a spring in said body and in which the jaw is articulated on the rod which is urged towards the front of the ski by said spring, said rod traversing a rear wall of the body through a hole provided therein, the hole being elongated in transverse direction, the rod being maintained vertically in its central position by the upper edge of the hole.

2. A safety binding according to claim 1, in which the two lines of support are symmetrical relative to the longitudinal plane of symmetry of the ski

3. A safety binding according to claim 1 wherein said upper edge of the hole ascends slightly at each side to permit a slight raising of the rod upon pivoting of the jaw around one of the support lines.

4. A safety binding according to claim 1, in which the jaw has a transverse face provided with recesses and the body has a transverse face and including thereon projections engageable in the said recesses and defining the lines of support and permitting relative movement between the jaw and the body.

5. A safety binding according to claim 4, in which the projections are constituted by ribs converging upwardly one towards the other and having rounded ends forming cylindrical surfaces of relatively small diameter to constitute the lines of support, the recesses being formed by converging grooves subtending between them the same angle as the ribs.

6. A safety binding according to claim 4, wherein the projections are constituted by two pairs of stems, and the recesses are formed by two pairs of vertical grooves provided in the transverse face of the jaw, the lower stems, on the one hand, and the upper, on the other hand, forming two pairs respectively located in planes parallel to the surface of the ski.

7. A safety binding according to claim 6 comprising a screw and in which the jaw is articulated on the rear end part of said threaded rod through the intermediary of said screw which is engaged in a tapped hole provided in said rear end part, which is itself engaged in a vertical recess provided in the transverse face of the jaw, means for engaging the screw with the jaw to prevent removal thereof after assembly with the threaded rod, the threaded engagement of the screw with the threaded rod permitting control of the height of the jaw.

* * * * *